US008008559B1

(12) United States Patent
Ward et al.

(10) Patent No.: US 8,008,559 B1
(45) Date of Patent: Aug. 30, 2011

(54) TREMOLO BLOCK

(75) Inventors: Frank R. Ward, Woodinville, WA (US); Kevin J. Hughes, Marysville, WA (US)

(73) Assignee: Frank R. Ward, Woodinville, WA (US)

( * ) Notice: Subject to any disclaimer, the term of this patent is extended or adjusted under 35 U.S.C. 154(b) by 0 days.

(21) Appl. No.: 12/751,882

(22) Filed: Mar. 31, 2010

(51) Int. Cl.
*G10D 3/00* (2006.01)

(52) U.S. Cl. ..... 84/313; 84/312 R

(58) Field of Classification Search ..... 84/312 R, 84/313

See application file for complete search history.

(56) References Cited

U.S. PATENT DOCUMENTS 7,557,282 B2 * 7/2009 Holdway ..... 84/299

* cited by examiner

*Primary Examiner* — Kimberly R Lockett
(74) *Attorney, Agent, or Firm* — Bruce A. Kaser

(57) ABSTRACT

A tremolo assembly includes a metallic block having an upper end near a pivoting mounting point. The lower end of the block depends downwardly into a space within a guitar body. The tremolo block has a proportionately greater mass near the lower end relative to the upper end that enhances the "vibrato" effect of the tremolo assembly.

6 Claims, 7 Drawing Sheets

TREMOLO BLOCK

TECHNICAL FIELD

The invention described here relates to an improved tremolo assembly for an electric guitar. The invention is designed to replace existing tremolo designs.

BACKGROUND

A tremolo arm is a lever that is attached to the bridge of an electric guitar. The tremolo arm allows a guitar player to vary the tension in the strings temporarily. Varying the tension allows the player to change pitch and create a "vibrato effect."

Earlier tremolo designs have used a solid block or tremolo plate to connect a series of springs to the tremolo structure. The springs are housed within the guitar's body and return the tremolo structure to the normal position after the guitar player releases the tremolo arm.

We have discovered that the "vibrato effect" of a tremolo assembly can be enhanced by adjusting the mass and metallic content of the tremolo block.

SUMMARY OF THE INVENTION

According to the invention described here, a tremolo block extends downwardly into a space within a guitar body. For the purpose of illustrating the general configuration of a tremolo assembly, reference is made to U.S. Pat. No. 3,241,418, which illustrates an example of early tremolo designs. The tremolo block disclosed here is designed to be used as a substitute for the structure indicated at item 32 in FIG. 2 of U.S. Pat. No. 3,241,418.

The difference between the tremolo block described here and the one in the '418 patent is as follows: in the present design, the tremolo block is made of a block of metal that has a generally rectangular footprint. It has been discovered that different "vibrato" effects can be accomplished by altering the type of metal used to make the block. More importantly, it was discovered that removing mass from the block near the fulcrum or point of pivot audibly enhances the vibrato effect. In other words, leaving a larger mass farther from the point where the assembly pivots enhances the overall effect of the tremolo device.

Different amounts of mass may be removed to "tune" the tremolo block to different pitches or guitar keys. In general, the tremolo block is a body that is housed within a hollow space in the guitar body.

The tremolo body has an upper portion that is adjacent or connected to a pivoting mounting point. A lower portion of the tremolo body depends downwardly relative to the pivoting point. It is important that the tremolo body be given a proportionately greater mass in the lower portion relative to the upper portion. This may be done in different ways. One way involves creating a recessed region or divoted area in the upper portion of the tremolo body that reduces the mass of the upper portion. This tends to create a spring-like action downwardly through the mass of the tremolo block such that the greater mass, positioned farther away from the pivot point, generates greater capacity to resonate and thus enhance the overall tremolo effect.

Preferably, the recessed region described above is created by milling horizontal grooves across one or the other side face of the tremolo body. In this instance, "side face" means the forward or rearward-looking side faces relative to the guitar neck. In other words, the "forward' side face faces the guitar neck and the aft or rearward side face faces the opposite direction.

Preferably, a pair of horizontal grooves are made across one side face and a single horizontal groove is made in the opposite side face. The collection of grooves is arranged so that the pair on one side will sandwich the grove on the other side. Looking at the tremolo body in cross-section, this creates an "S" shaped or serpentine cross-sectional configuration in the upper portion of the tremolo body that enhances the spring-like effect described above.

The invention as summarized above will become more clearly understood upon reviewing the following description which is to be read in conjunction with the attached drawings.

BRIEF DESCRIPTION OF THE SEVERAL VIEWS OF THE DRAWINGS

In the drawings, like reference symbols and letters refer to like parts throughout the various views, and wherein.

BEST MODE FOR CARRYING OUT THE INVENTION

Figure 1:
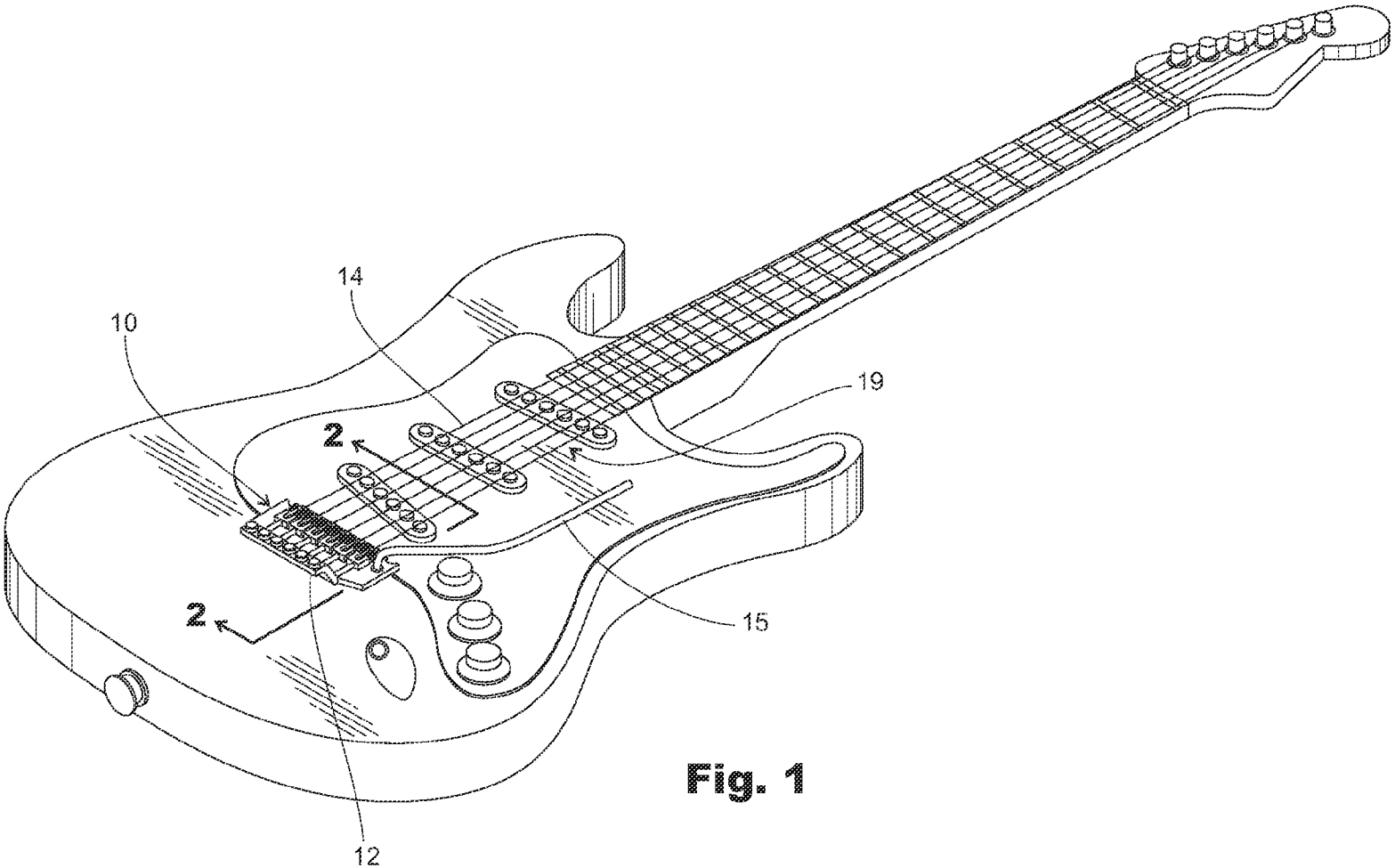
FIG. 1 is a pictorial view of a guitar and shows the general location of a tremolo assembly in accordance with a preferred embodiment of the invention.

Referring now to the drawings, and first to FIG. 1, shown generally at 10 is a tremolo assembly constructed in accordance with the preferred embodiment of the invention. FIG. 1 shows the top part of the tremolo assembly 10. The tremolo assembly 10 has a rectangular tremolo body portion or block 11 (see FIG. 2) that extends downwardly into a space, indicated generally at 13 in FIG. 2.

Figure 3:
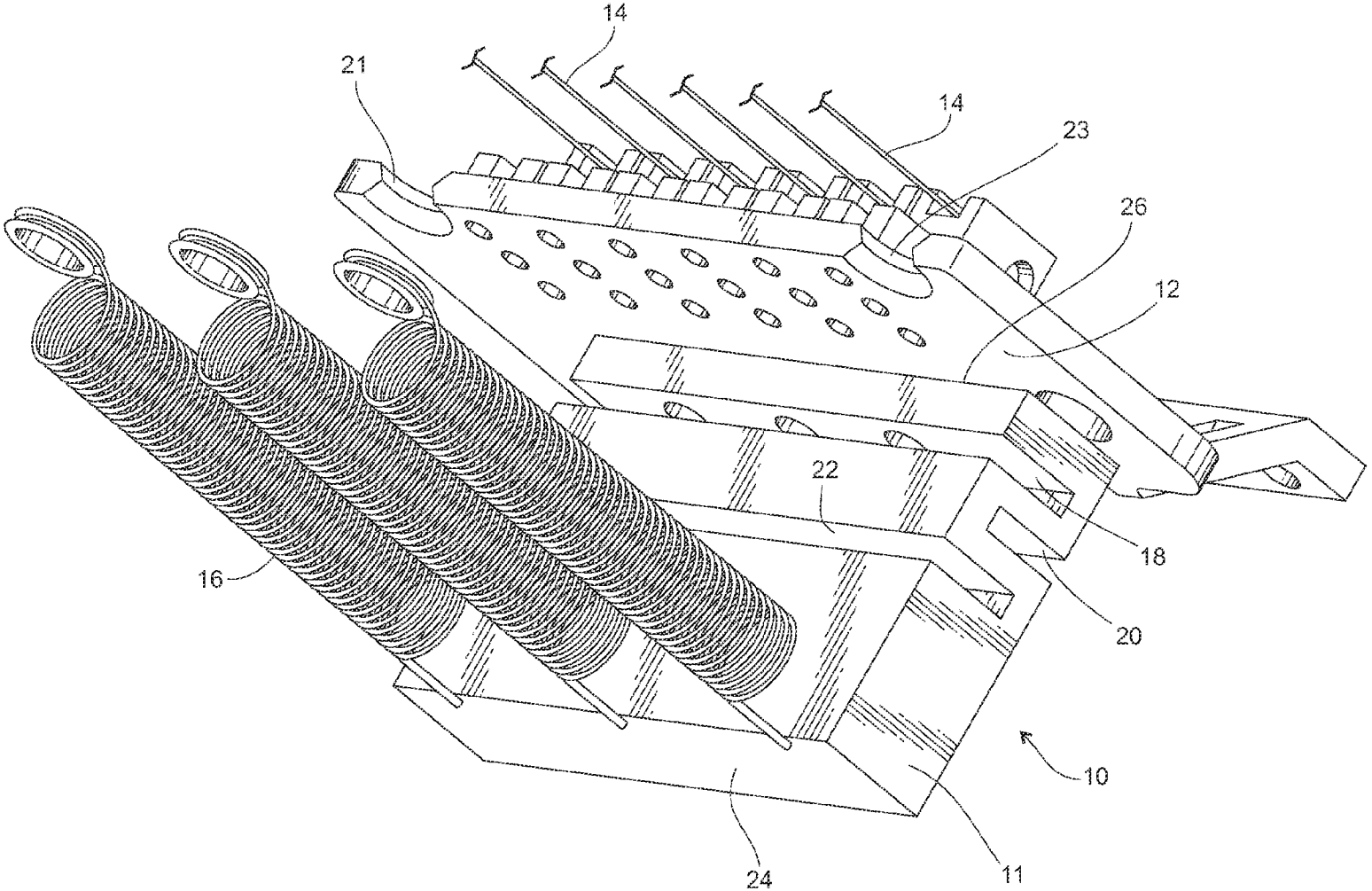
FIG. 3 is a pictorial view of the tremolo assembly as depicted in FIG. 2, but with the guitar strings.
Figure 4:
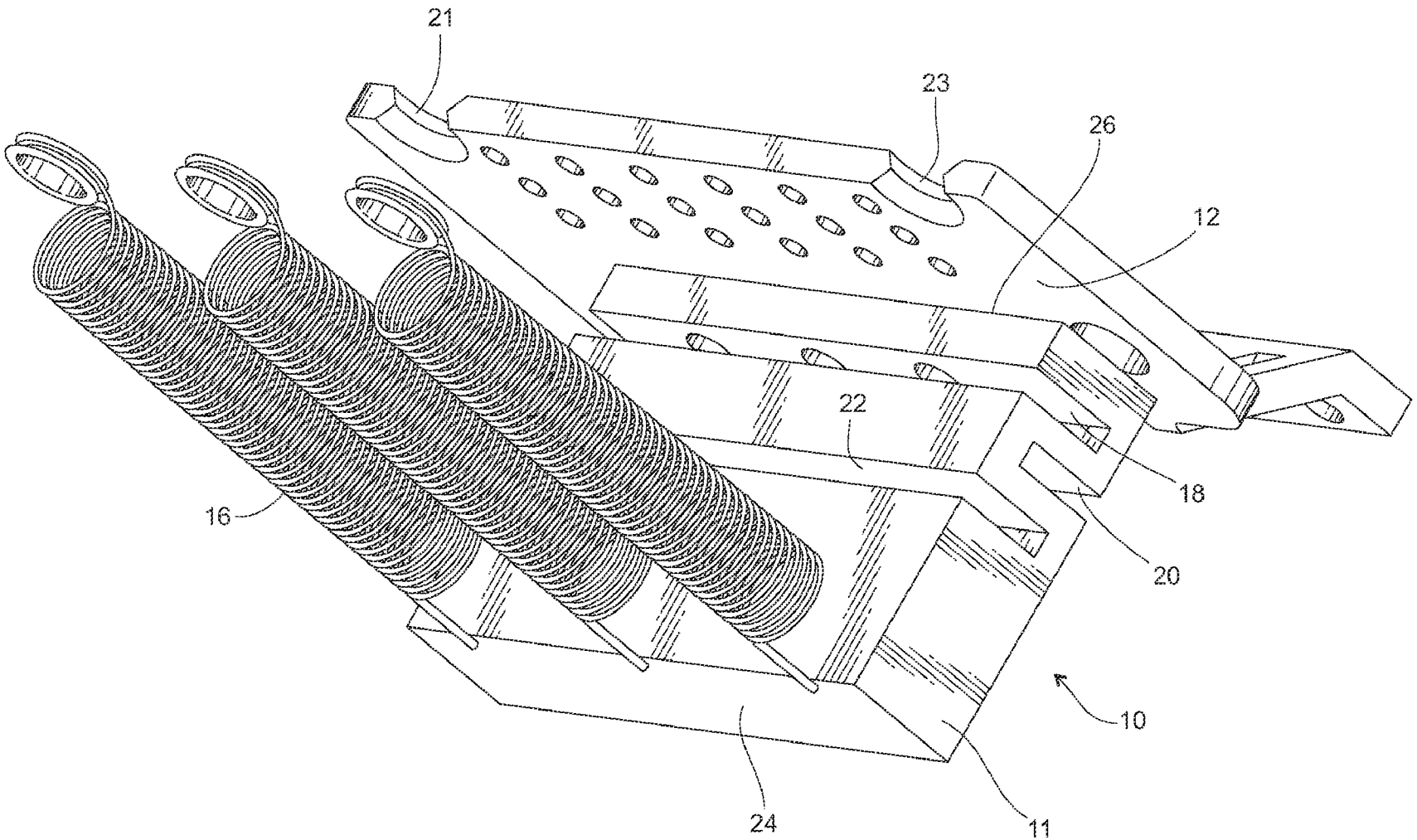
FIG. 4 is a view like FIG. 3, but with the guitar strings removed.
Figure 5:
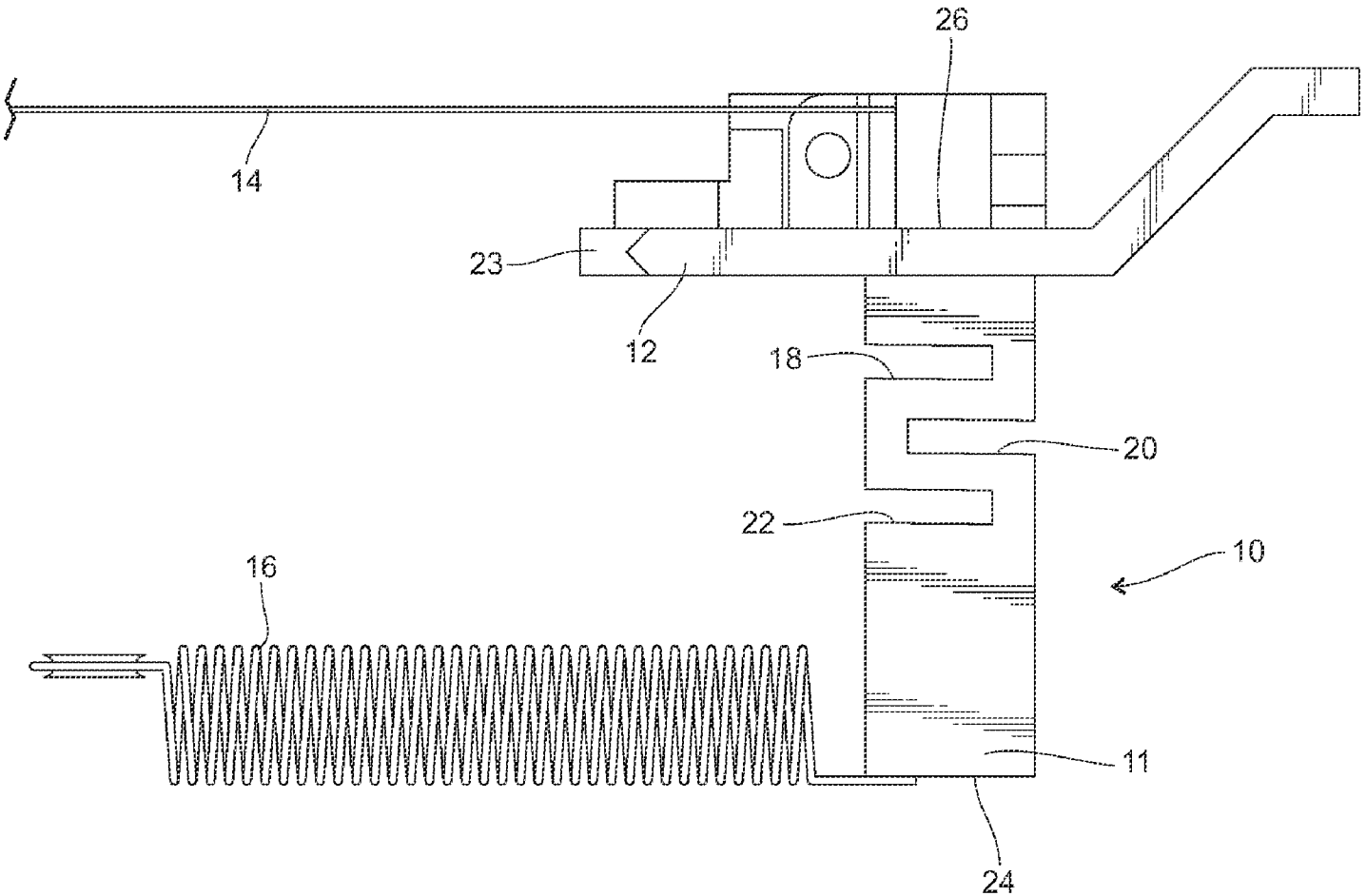
FIG. 5 is a side elevation of the tremolo assembly shown in FIGS. 3 and 4.
Figure 6:
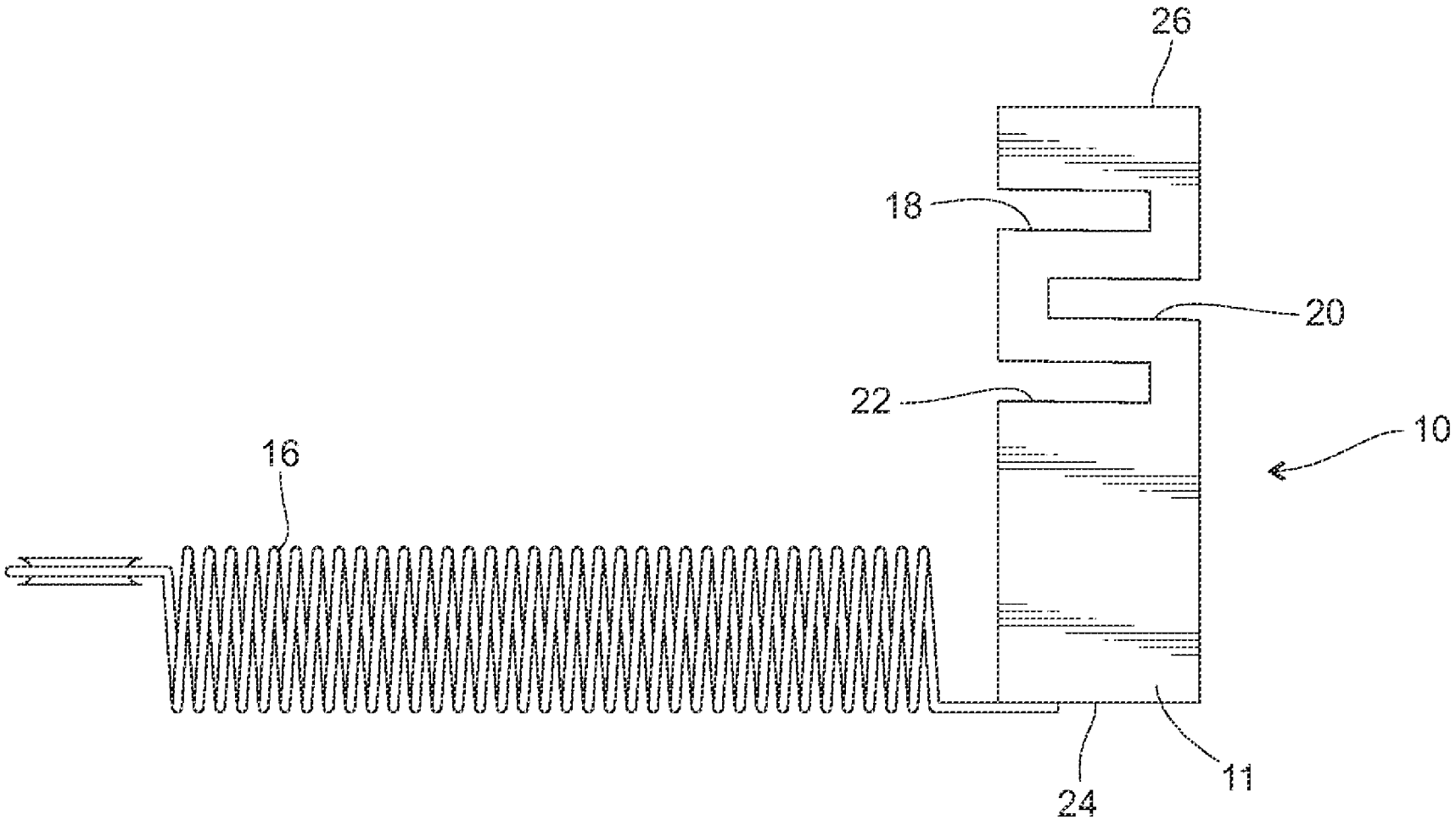
FIG. 6 is a side elevation similar to FIG. 5, but shows only the tremolo assembly without upper mounting structure and with a spring for returning the tremolo body portion to a normal position.
Figure 7:
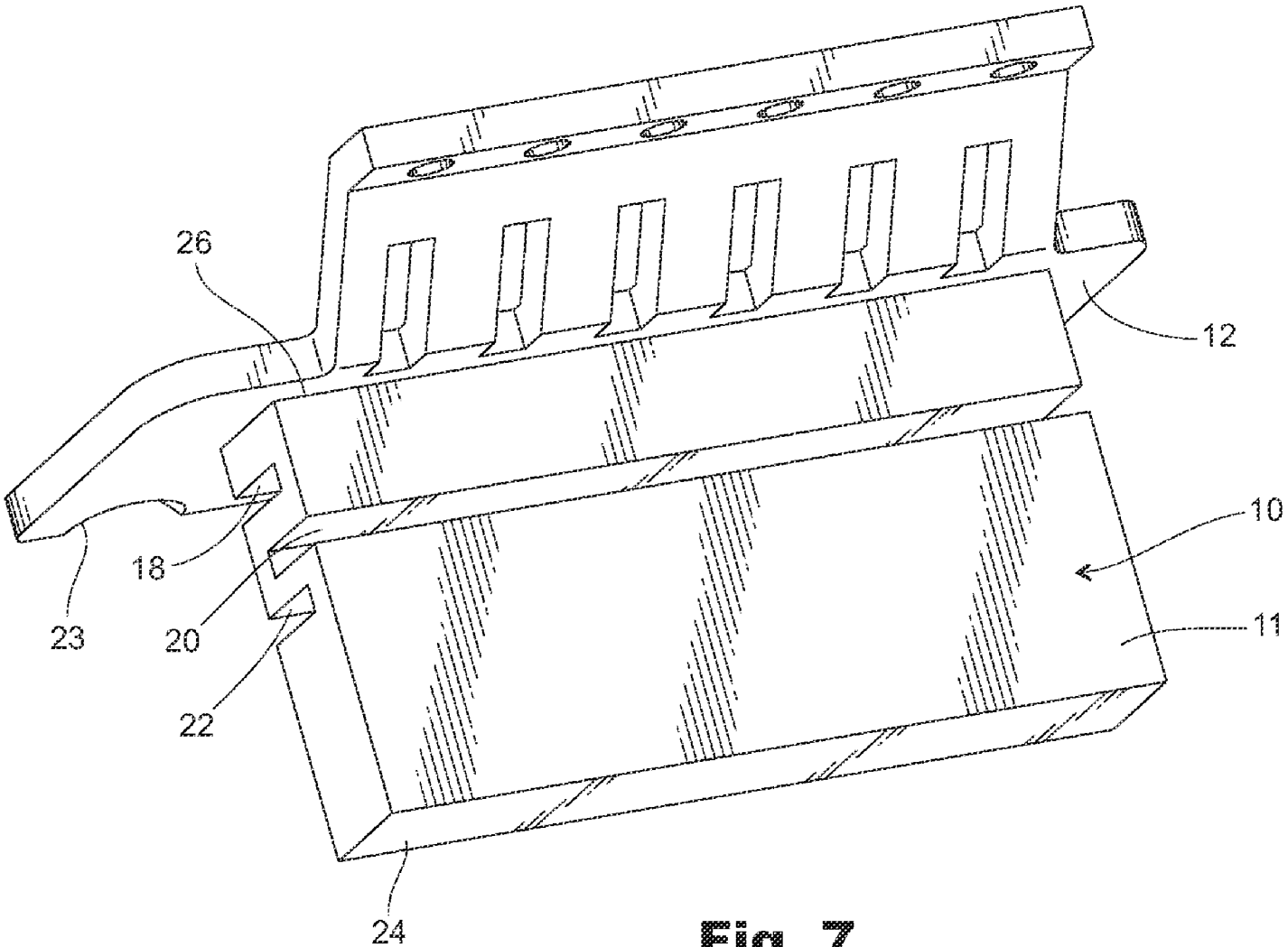
FIG. 7 is a pictorial view looking at the back side of the tremolo assembly.

Returning to FIG. 1, the tremolo assembly 10 is pivoted by the guitar user via a handle 15. This causes the tremolo block 11 to swing about a pivot point, the location of which is generally indicated at 17 in FIG. 2. The pivoting arrangement is common to tremolo designs and is the same as what is envisioned in U.S. Pat. No. 3,241,418 (incorporated hereby reference). The pivoting action is well understood by persons familiar with tremolo designs. Referring to FIGS. 3 and 4, items 21, 23 define the parts of the assembly 10 that capture pivot points on the guitar body.

The user either pulls or pushes on the handle 15. Pulling the handle 15 upward stretches the guitar strings (generally indicated at 19 in FIG. 1). The tension in the strings returns the tremolo assembly 10 (and body or block 11) to its original position when the handle 15 is released. Similarly, pushing the handle 15 reduces tension in the strings. In this instance, however, a series of springs 16 (see FIGS. 2-6) return the tremolo assembly 10 to its original position.

The tremolo block 11 is connected to the bottom of the assembly 10 via a plate 12. Referring to FIG. 3, the plate 12 carries a bridge for the guitar strings, indicated at 14. As is typical with tremolo designs, the tremolo block and plate structure 11, 12 are designed to pivot, driven by the guitar lever arm 15, which adjusts the string tension as the guitar is played.

Figure 2:
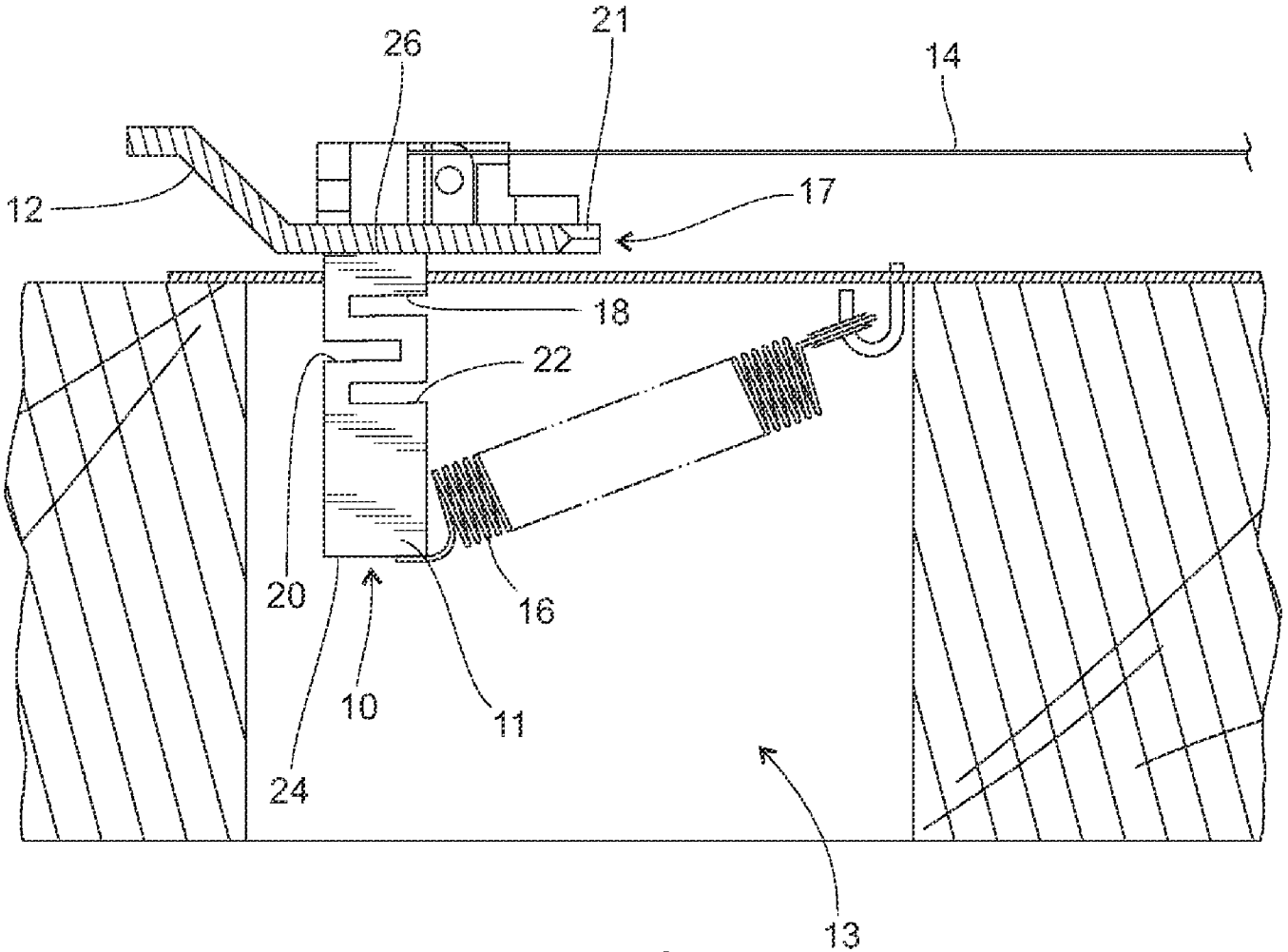
FIG. 2 is a side view of a tremolo assembly constructed in accordance with the invention, and illustrates a tremolo body portion inside a hollow space within the guitar shown in FIG. 1.

As is best seen in FIG. 2, the tremolo block 11 has a generally rectangular footprint that extends downwardly below the surface of the guitar. The lower end of the block is connected to the springs 16 previously described. The purpose of the springs 16 is to return the plate and tremolo block assembly 11, 12 to its normal position when the lever arm is released by the guitar player.

The improvement lies in the grooves 18, 20, 22 that are machined in the tremolo block 11. The grooves remove mass near the pivot point of the combined structure 11, 12. Thus, the grooves 18, 20, 22 create a greater inertial mass near the springs 16, much like putting a weight on the end of flexible stem, by analogy. Preferably, the block 11 is made from brass, although there are probably many suitable metallic materials that will work similarly to brass. Material selection can be used to tune the tremolo assembly 10.

It was learned that removing material from the block 11 in this way enables "tuning" the tremolo assembly 10 to the guitar. Thus it is possible to remove different amounts of material in the manner described above and thereby tune the tremolo assembly 10 to different musical keys, for example, if desired.

As is apparent from the Figs., in preferred form, the tremolo body or block 11 has a pair of grooves 18, 22, in one side face (the forward side face relative to the guitar neck). An aft groove 20 is sandwiched between the forward grooves 18, 22. This creates a serpentine structural configuration with reduced mass in the upper portion of the tremolo body 11.

The size and number of the grooves 18, 20, 22 is a variable depending on how it is desired to "tune" the tremolo assembly 10. In some instances, a single horizontal groove may be desirable in lieu of the sandwiched set described above. A person skilled in the art would realize that there are different ways of milling grooves on one side or the other of the tremolo body 11 in order to obtain the desired effect. However, it is important to have a greater mass near the lower end 24 (see FIG. 2) compared to the upper end 26 of the tremolo body 11.

The tremolo assembly 10 was created for the purpose of generating more tone from a conventional tremolo bridge. It is believed that the springs 16 that are normally part of a tremolo body dampen the bridge action of conventional designs. Adding weight to the "block" 11 may be helpful, but only within a narrow tonal range. Adding weight means increasing the size of the block 11 or using a metal of greater density, if possible. Dividing the block 11 by creating upper and lower areas of mass (respectively indicated at 26 and 24 in FIG. 2) causes improvements to the tone.

In essence, the upper grooves 18, 20, 22 divide the weight and create a "spring-like section" that results in the block 11 becoming more "live." The effect is to complement and emphasize the entire tonal range.

A block 11 constructed in accordance with the invention is able to move in two directions at once and is therefore more free to resonate and amplify the effects of the already resonating bridge portion 12 of the overall tremolo assembly 10. Moreover, the top portion 26 of the block 11 (with the grooves 18, 20, 22) appears to resonate up and down with the tremolo bridge 12, while the lower part 24 of the block 11 may resonate back and forth with the springs 16.

The "spring-like" action created by horizontal grooves 18, 20, 22 essentially creates two masses that are independent and free to move in their own natural directions. In essence, the bridge 12 is one mass that makes the tremolo assembly 10 work. The recessed portion of the upper portion of the block 11 (defined by grooves 18, 20, 22) creates a spring with another lower mass defined by the lower part 24 of the block body 11. This actually causes notes to bloom and be exaggerated with a noticeable increase in sustain. It has been learned that some guitars achieve a doubling of sustain time.

The foregoing description is not intended to limit the spirit and scope of the invention. Instead, the scope of the invention right is to be limited by the patent claim or claims that follow, the interpretation of which is to be made in accordance with the standard doctrines of patent claim interpretation.

What is claimed is as follows:

1. A tremolo body for a guitar having an upper portion adjacent to a pivoting mounting point, and a lower portion depending downwardly relative to the pivoting point, and wherein the tremolo body has a proportionately greater mass in the lower portion relative to the upper portion, wherein the upper portion of the body has a recessed region that reduces the mass of the upper portion relative to the lower portion, and wherein the recessed region at least comprises a first horizontal groove across one side face of the tremolo body.

2. The tremolo body of claim 1, wherein the recessed region further comprises a plurality of horizontal grooves, including a pair of horizontal grooves across a another side face of the tremolo body that is opposite said at least one side face, and wherein said pair of grooves on said other face are spaced such that the first groove is intermediately positioned relative to the pair of grooves.

3. A tremolo body for a guitar, the tremolo body having a generally rectangular shape, with an upper end portion adjacent to a pivoting mounting point, and a lower end portion depending downwardly relative to the pivoting point, and wherein the tremolo body further includes a plurality of grooves in an upper portion of the body, for removing mass from the body, and to provide the tremolo body with a proportionately greater mass in the lower end portion relative to the upper end portion, wherein the grooves are located on forward and aft surfaces of the tremolo body, and wherein the grooves are spaced such that a first groove is on one side of the body, and at least a pair of grooves are on opposite side of said body, and wherein the first groove is intermediately positioned relative to the pair of grooves.

4. The tremolo body of claim 3, wherein the grooves are arranged horizontally on the tremolo body.

5. A tremolo body for a guitar having an upper portion adjacent to a pivoting mounting point, and a lower portion depending downwardly relative to the pivoting point, and wherein the tremolo body has a proportionately greater mass in the lower portion relative to the upper portion, and further, a recessed region in a side surface of said tremolo body, spaced a distance below said pivoting mounting point, said recessed region being shaped to remove mass from said tremolo body in a manner so as to create said proportionately greater mass in the lower portion relative to the upper portion of the tremolo body.

6. The tremolo body of claim 5, wherein said recessed area comprises at least one horizontal groove across at least one of a forward side surface of said body and an aft side surface of said body.

* * * * *